US009020380B2

(12) United States Patent
Shida

(10) Patent No.: US 9,020,380 B2
(45) Date of Patent: Apr. 28, 2015

(54) IMAGE FORMING APPARATUS FOR PERFORMING CONTROL OF IMAGE FORMING CONDITION AND DENSITY DETECTION APPARATUS FOR DETECTING THE DENSITY OF TEST PATTERN

(71) Applicant: Canon Kabushiki Kaisha, Tokyo (JP)

(72) Inventor: Tomonori Shida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/034,978

(22) Filed: Sep. 24, 2013

(65) Prior Publication Data

US 2014/0119755 A1 May 1, 2014

(30) Foreign Application Priority Data

Oct. 26, 2012 (JP) ..... 2012-237273

(51) Int. Cl.
*G03G 15/00* (2006.01)
*G03G 15/01* (2006.01)

(52) U.S. Cl.
CPC ..... *G03G 15/0189* (2013.01); *G03G 15/5058* (2013.01)

(58) Field of Classification Search
USPC ..... 399/49, 74
See application file for complete search history.

(56) References Cited

U.S. PATENT DOCUMENTS

| | | | | |
|---|---|---|---|---|
| 7,805,100 | B2 * | 9/2010 | Miyadera | 399/301 |
| 7,894,101 | B2 | 2/2011 | Ichinose et al. | |
| 7,957,659 | B2 | 6/2011 | Nada et al. | |
| 8,472,829 | B2 * | 6/2013 | Atsumi et al. | 399/74 |
| 2005/0147424 | A1 * | 7/2005 | Kato et al. | 399/49 |
| 2011/0052232 | A1 * | 3/2011 | Ohshima et al. | 399/49 |
| 2011/0085809 | A1 * | 4/2011 | Bae et al. | 399/29 |
| 2012/0163842 | A1 * | 6/2012 | Murayama | 399/49 |
| 2012/0288291 | A1 * | 11/2012 | Miyadera | 399/51 |
| 2013/0114968 | A1 | 5/2013 | Shida et al. | |
| 2013/0243458 | A1 * | 9/2013 | Suzuki et al. | 399/49 |

FOREIGN PATENT DOCUMENTS

| | | | |
|---|---|---|---|
| JP | 2005-275143 | A | 6/2005 |
| JP | 2005-241933 | A | 9/2005 |
| JP | 2006-139179 | A | 6/2006 |
| JP | 2009-134037 | A | 6/2009 |
| JP | 2011-008291 | A | 1/2011 |

* cited by examiner

*Primary Examiner* — Clayton E LaBalle
*Assistant Examiner* — Ruifeng Pu
(74) *Attorney, Agent, or Firm* — Fitzpatrick, Cella, Harper & Scinto

(57) ABSTRACT

An image forming apparatus includes an image forming unit, which forms a test pattern for density control on the image carrier; and first and second light receiving elements, which receive reflected light irradiated by a light emitting element. A spot diameter of a reflected light received by the first light receiving element is smaller than a spot diameter of a reflected light received by the second light receiving element, and a number of sampling of the test pattern in line with a movement direction of a surface of the image carrier by the first light receiving element is greater than that of the test pattern in line with the moving direction by the second light receiving element.

22 Claims, 10 Drawing Sheets

IMAGE FORMING APPARATUS FOR PERFORMING CONTROL OF IMAGE FORMING CONDITION AND DENSITY DETECTION APPARATUS FOR DETECTING THE DENSITY OF TEST PATTERN

BACKGROUND OF THE INVENTION

1. Field of the Invention

The present disclosure relates to a density detection technique of an image forming apparatus using an electrophotographic method, for example, a copier, printer, or facsimile.

2. Description of the Related Art

At present, as image output terminals, image forming apparatuses, such as printers, have become widespread owing to the development of computer network technologies, and in recent years, the demand for improving the stability of the image quality of images formed by image forming apparatuses has heightened. Relating in particular to the density reproducibility of images, a sophisticated stability is being sought that does not vary with changes in the installation environment of the image forming apparatus, or temporal changes, or depends on characteristic difference of each apparatus. However, the density of an image formed by an image forming apparatus varies based on changes in each driving member or image forming member owing to continuous use, or fluctuations in temperature within the apparatus, or the like; therefore, it is not possible to meet the demanded high level of stability by keeping the initial settings. Therefore, it is common to perform calibration (hereafter, called "density control") in order to maintain optimum image density.

In density control, first a developer image for test purposes (hereafter, called a "test pattern") is formed on a cyclically moving member, for example, a photosensitive member, an intermediate transfer member, or a feeding belt, and a physical quantity that correlates with the position of the test pattern and an amount of developer is measured using a sensor. Using these measurement results and the conditions at the time of forming a test pattern, each of the control targets, such as charging bias, developing bias, and exposure amount, are then controlled so that the actual image density at printing is suitable.

Moreover, in order to detect a test pattern with a sensor, the test pattern must be made larger than the spot diameter of the light irradiated by the sensor. On the other hand, the developer consumed in density control is considered wasted consumption on the part of the apparatus by the user, and must be reduced as much as possible.

Japanese Patent Laid-Open No. 2005-241933 discloses an optical sensor with high precision of irradiation angle even with a small aperture on the light emitting side, and with high accuracy of reading of the test pattern regardless of variation in irradiated area owing to manufacturing variation. Density can be detected accurately with this optical sensor, even for a relatively small test pattern, because the spatial resolution and detection accuracy can be increased together. Japanese Patent Laid-Open No. 2009-134037 discloses a density control method that uses a sensor having two photodiodes which respectively receive specular reflected light and diffuse reflected light from a test pattern. Japanese Patent Laid-Open No. 2009-134037 indicates that the size of the test pattern for density control depends on the spot diameter of the diffuse reflected light, which is larger in size than that of the specular reflected light.

With respect to image forming apparatuses, further reduction of the amount of developer consumed in order to form a test pattern for density control purposes is being sought. At the same time, a high level of image density reproducibility is desired. Therefore, an effective detection method for performing accurate density control even for small test patterns is required. In order to suppress the effects of variation in the surface conditions of the target objects for which a test pattern is to be formed, even in cases where a sensor with high spatial resolution and high detection precision is used, it is necessary to average a degree of the measurement results. Further, it is necessary to calculate the amount of diffuse reflected light in order to accurately calculate the amount of specular reflected light; therefore, it is necessary to detect the amount of specular reflected light and diffuse reflected light from the same area. Here, the spot diameter of diffuse reflected light is larger than the spot diameter of specular reflected light; therefore, when detecting the amount of specular reflected light and amount of diffuse reflected light from the same area of the target object, the spot diameter of the diffuse reflected light is a factor in determining the size of the test pattern.

SUMMARY OF THE INVENTION

According to an aspect of the present invention, an image forming apparatus includes an image carrier; an image forming unit configured to form a test pattern which is a developer image for density control on the image carrier; and a detection unit including a light emitting element configured to irradiate light directed at the image carrier or the test pattern, and a first light receiving element and a second light receiving element configured to receive reflected light of the light irradiated by the light emitting element. The image forming apparatus performs control of the image forming conditions for the image forming unit based on a detection result of the test pattern by the detection unit, a spot diameter of a reflected light received by the first light receiving element is smaller than a spot diameter of a reflected light received by the second light receiving element, and a number of sampling of the test pattern in line with a movement direction of a surface of the image carrier by the first light receiving element is greater than that of the test pattern in line with the moving direction by the second light receiving element.

Further features of the present invention will become apparent from the following description of exemplary embodiments with reference to the attached drawings.

DESCRIPTION OF THE EMBODIMENTS

Exemplary embodiments of the present invention will now be described with reference to the accompanying drawings. In each figure below, structural elements that are not necessary in the description of the embodiments are omitted from the Figures. Further, the specific numerical values used in the descriptions below are merely for example, and the present invention is not limited to the specific numerical values used in the descriptions below.

First Embodiment

Figure 1:
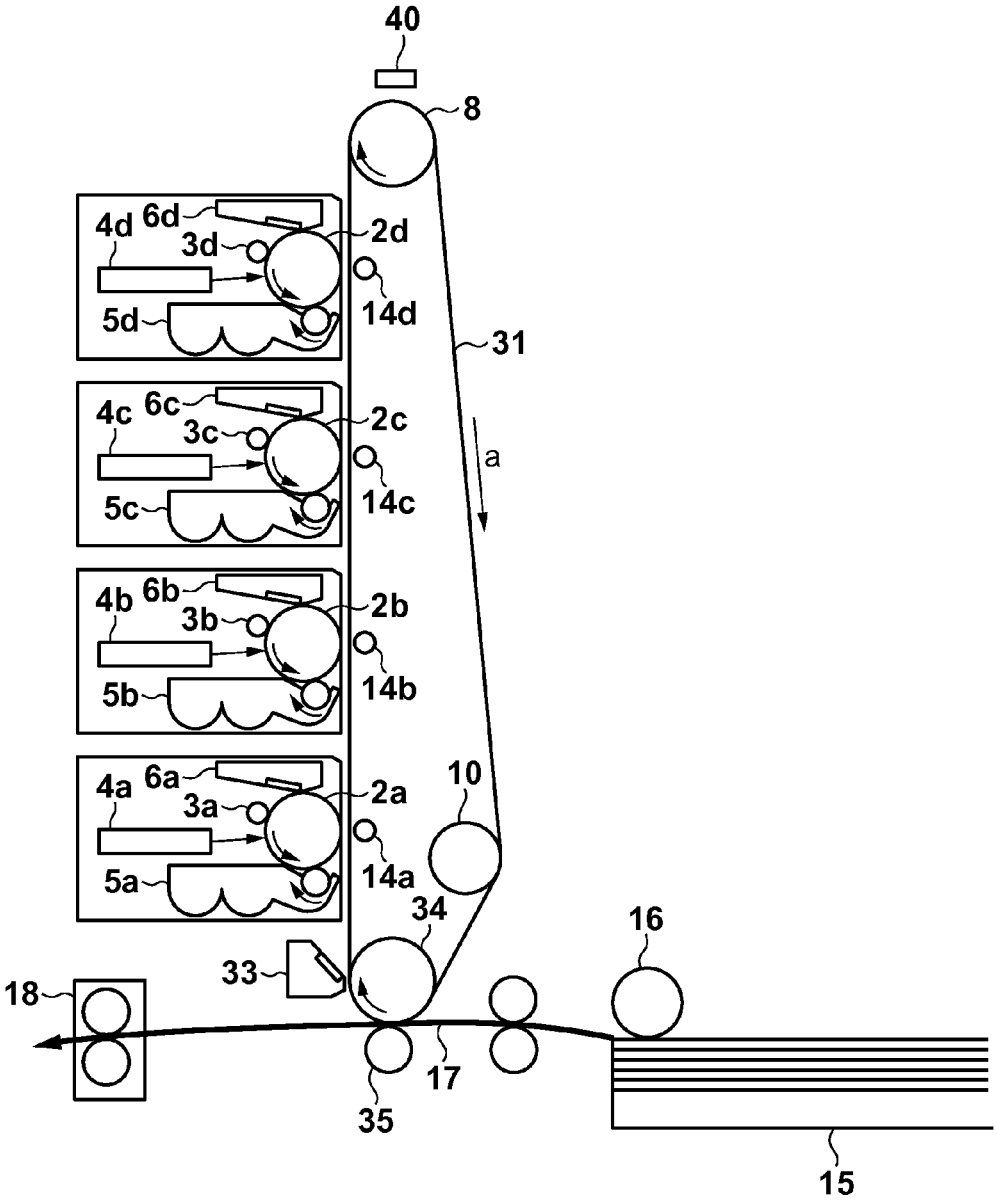
FIG. 1 is a schematic diagram illustrating an outline of an imaging forming unit of an image forming apparatus according to an embodiment.

FIG. 1 is a schematic diagram illustrating an outline of an imaging forming unit of an image forming apparatus according to an embodiment. In FIG. 1, the structural elements whose reference numerals end with the characters a, b, c, and d respectively indicate members that form yellow, magenta, cyan, and black developer images on the intermediate transfer belt 31. In cases where it is not necessary to distinguish colors, a reference numeral without an end character will be used. Rotationally driven photosensitive member 2 is uniformly charged to the polarity and potential predetermined by the corresponding charge roller 3. An exposure unit 4 forms an electrostatic latent image on a photosensitive member 2 by scanning the corresponding photosensitive member 2 with light. Developing unit 5 forms a developer image by causing a developer (toner) to adhere onto the electrostatic latent image on a corresponding photosensitive member 2. A primary transfer roller 14, which is positioned opposite a photosensitive member 2, with the intermediate transfer belt 31 in between as the image carrier, transfers the developer image of the photosensitive member 2 to the intermediate transfer belt 31 by applying a primary transfer voltage. Moreover, by transferring and overlapping the developer images of the photosensitive members 2 corresponding to each color to the intermediate transfer belt 31, a color image is formed. Any developer not transferred from the photosensitive member 2 to the intermediate transfer belt 31 and remaining on the photosensitive member 2 is removed and recovered by the cleaning unit 6.

The intermediate transfer belt 31 is looped around the driving roller 8, tension roller 10, and opposite roller 34, and is rotationally driven in the direction of arrow a in the diagram by the driving roller 8, while the tension roller 10 maintains a predetermined tension. The intermediate transfer belt 31 is, for example, in the form of an endless belt with a thickness of about 50 to 150 μm, and a material black in color and having a high reflectivity is used. Specifically, as the material for the intermediate transfer belt 31, a super engineering plastic such as polyamide, PEEK, PPS, PVdF, or PEN, or a general purpose engineering plastic such as PET can be used.

The printing material contained in the cassette 15 is fed out by the feeding roller 16 to the feed path 17. The secondary transfer roller 35 transfers the developer image on the intermediate transfer belt 31 to the printing material fed through the feed path 17 by applying a secondary transfer voltage. Moreover, the developer remaining on the intermediate transfer belt 31 after secondary transfer is removed by the cleaning unit 33. The printing material is then fed to the fixing unit 18 where a developer image is fixed, and discharged out of the image forming apparatus. Further, a sensor 40 for detecting a test pattern formed on the intermediate transfer belt 31, which faces the intermediate transfer belt 31 in the image forming unit, is provided.

Figure 2:
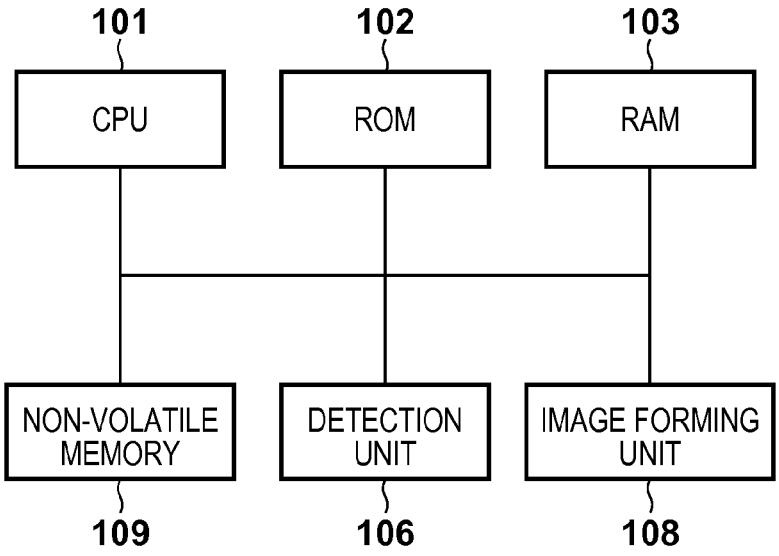
FIG. 2 is a block diagram illustrating the control configuration of an image forming apparatus according to an embodiment.

FIG. 2 is an exemplary block diagram of a control configuration of an image forming apparatus according to this embodiment. A CPU 101 uses a RAM 103 as a work area, and controls each unit of the image forming apparatus based on various types of control program stored in a ROM 102. In the ROM 102, various control programs and various data and tables, and the like, are stored. The RAM 103 is used as a program loading area, a work area of the CPU 101, and a storing area for the various data. A detection unit 106 includes a sensor 40, and detects a test pattern formed on the intermediate transfer belt 31. An image forming unit 108 performs image forming in the manner described in relation to FIG. 1, under the control of CPU 101. A non-volatile memory 109 stores various data such as the light power settings at the time of executing density control, or the like.

Figure 3:
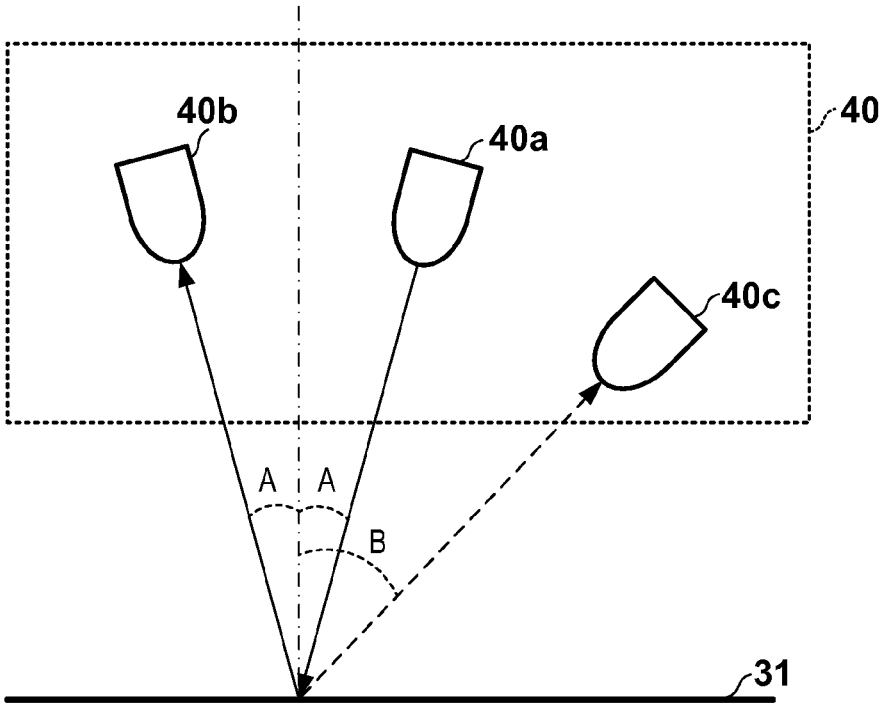
FIG. 3 is a diagram illustrating a sensor according to an embodiment.

Next, sensor 40 will be described in detail using FIG. 3. The sensor 40 has a light emitting element 40*a*, and two light receiving elements 40*b* and 40*c*, as illustrated in FIG. 3. The light emitting element 40*a* emits, for example, infra-red light of wavelength 950 nm, directed at the intermediate transfer belt 31. The light receiving elements 40*b* and 40*c* receive the light emitted by the light emitting element 40*a* and reflected from the test pattern formed on or above the surface of the intermediate transfer belt 31. The detection unit 106 shown in FIG. 2 calculates an amount of adhered developer based on a signal output by the two light receiving elements 40*b* and 40*c* in response to the amount of received light. Moreover, for example, the maximum voltage output by the light receiving elements 40*b* and 40*c* is 3.3V.

This embodiment is arranged such that the light receiving element 40*b* receives light emitted by the light emitting element 40*a* and is specularly reflected by the intermediate transfer belt 31. Conversely, the light receiving element 40*c* is arranged so as not to receive light emitted by the light emitting element 40*a* and specularly reflected by the intermediate transfer belt 31. Accordingly, and as indicated in FIG. 3, in this embodiment, the emission angle of the light emitting element 40*a* and the light reception angle of the light receiving element 40*b* (the first light receiving element) are the same angle A with respect to the normal direction of the intermediate transfer belt 31. In contrast, the light reception angle of the light receiving element 40*c* (the second light receiving element) makes an angle B with respect to the normal direction of the intermediate transfer belt 31, which is different from the angle A. As an example, angle A is 15° and angle B is 45°. Therefore, the reflected light received by the light receiving element 40*b* comprises a specular reflected component and a diffuse reflected component. On the other hand, the reflected light received by the light receiving element 40*c* includes only a diffuse reflected component. As developer adheres to the intermediate transfer belt 31, the specular reflected light will reduce due to being blocked by the developer, and as a result, the output of the light receiving element 40*b* will decrease. Further, the 950 nm wavelength infra red light that is irradiated by the light emitting element 40*a* is absorbed by the black developer, but is diffusely reflected by the yellow, magenta, and cyan developers. Therefore, when the amount of yellow, magenta, and cyan developer adhered to the intermediate transfer belt 31 increases, the output of the light receiving element 40*c* becomes large. Moreover, the light receiving element 40*b* is also affected. In other words, with respect to yellow, magenta, and cyan, even if the amount of developer adhered is large, and the surface of the intermediate transfer belt 31 is covered with developer, the output of the light emitting element 40*b* and 40*c* will not become zero.

In this embodiment, the aperture diameter of the light receiving element 40*b* is made smaller than the light receiving element 40*c*, in order to minimize the effect of the diffuse reflected component. For example, it is possible to make the aperture diameters of the light emitting element 40*a*, light receiving element 40*b*, and light receiving element 40*c*, 0.7 mm, 1.5 mm, and 2.9 mm respectively. Therefore, the detection range of the specular reflected component by the light receiving element 40*b* is about ϕ1.0 mm, and the detection range of the diffuse reflected component by the light receiving element 40*c* corresponds to the spread of the irradiation by light emitting element 40*a*, and is about ϕ3.0 mm. Below, the spot diameter of the light received by the light receiving element 40*b* is called the specular reflection spot diameter, and the spot diameter of the light received by the light receiving element 40*c* is called the diffuse reflection spot diameter.

[Image Density Control]

In an image forming apparatus, the characteristics of the developer and of each unit involved with image forming changes according to conditions such as the exchange of consumable parts, changes in the environment in which it is used (temperature, humidity, degradation of the apparatus, etc.), and the number of pages printed. These changes in characteristics are exposed as fluctuations in image density and changes in color reproducibility. In other words, due to these fluctuations, reproducibility of the original, correct color can not be achieved. Then, in the present embodiment, during a period in which image forming is not performed, when predetermined conditions are met, a plurality of test patterns for density control is formed on the intermediate transfer belt 31 and their densities are detected by sensor 40. Then, based on these detection results, the image forming conditions, in other words, the control target that is affected by the image density is controlled. Here, the control target that is affected by the image density is, for example, charge bias, developing bias, exposure intensity, a tone correction table, or the like. In this embodiment, the tone correction table is chosen to be controlled, but this is merely an example, and other control targets are acceptable.

The outputs of the light receiving elements 40*b* and 40*c* change based on, for example, temporal changes in tint of the surface of the intermediate transfer belt 31, which is the detection target surface, and variation in the lot of sensor 40. For this reason, it is important to periodically perform light intensity adjustment in order to readjust the optimum light intensity settings of the light emitting element 40*a* to be used in density control, as necessary. Regarding the light intensity adjustment, the light receiving elements 40*b* and 40*c* first receive reflected light from the surface of the intermediate transfer belt 31 itself. In this way, the signals output by the light receiving elements 40*b* and 40*c* when reflected light from the surface of the intermediate transfer belt 31 itself is received are respectively called signal Bb and signal Bc. Next, the light receiving elements 40*b* and 40*c* receive reflected light in the substantially central portion of a test pattern formed on the intermediate transfer belt 31 for the purpose of light intensity adjustment. In this way, the signals output by the light receiving elements 40*b* and 40*c* when receiving reflected light from the test pattern are respectively called signal Pb and signal Pc. Further, the test pattern for light intensity adjustment is a solid image of three chromatic colors (yellow, magenta, and cyan). The light intensity adjustment is performed by ensuring that the amplitudes of all of signals Bb, Bc, Pb, and Pc are not more than a predetermined value. Further, these signals are obtained across one cycle of the intermediate transfer belt 31. For example, in a case where the maximum output voltage of the light receiving elements 40*b* and 40*c* is 3.3V, the light intensity can be adjusted such that the maximum value of signals Bb, Bc, Pb, and Pc is 2.5V. The reason for making the value smaller than the maximum output voltage is to prevent a measurement error owing to saturation of the output voltage, and by making the target voltage as large as possible, the maximum dynamic range can be secured. Further, the optimum light intensity of the light emitting element 40*a* sought in this way is stored in a non-volatile memory 109, to be used in the next density control.

Figure 4:
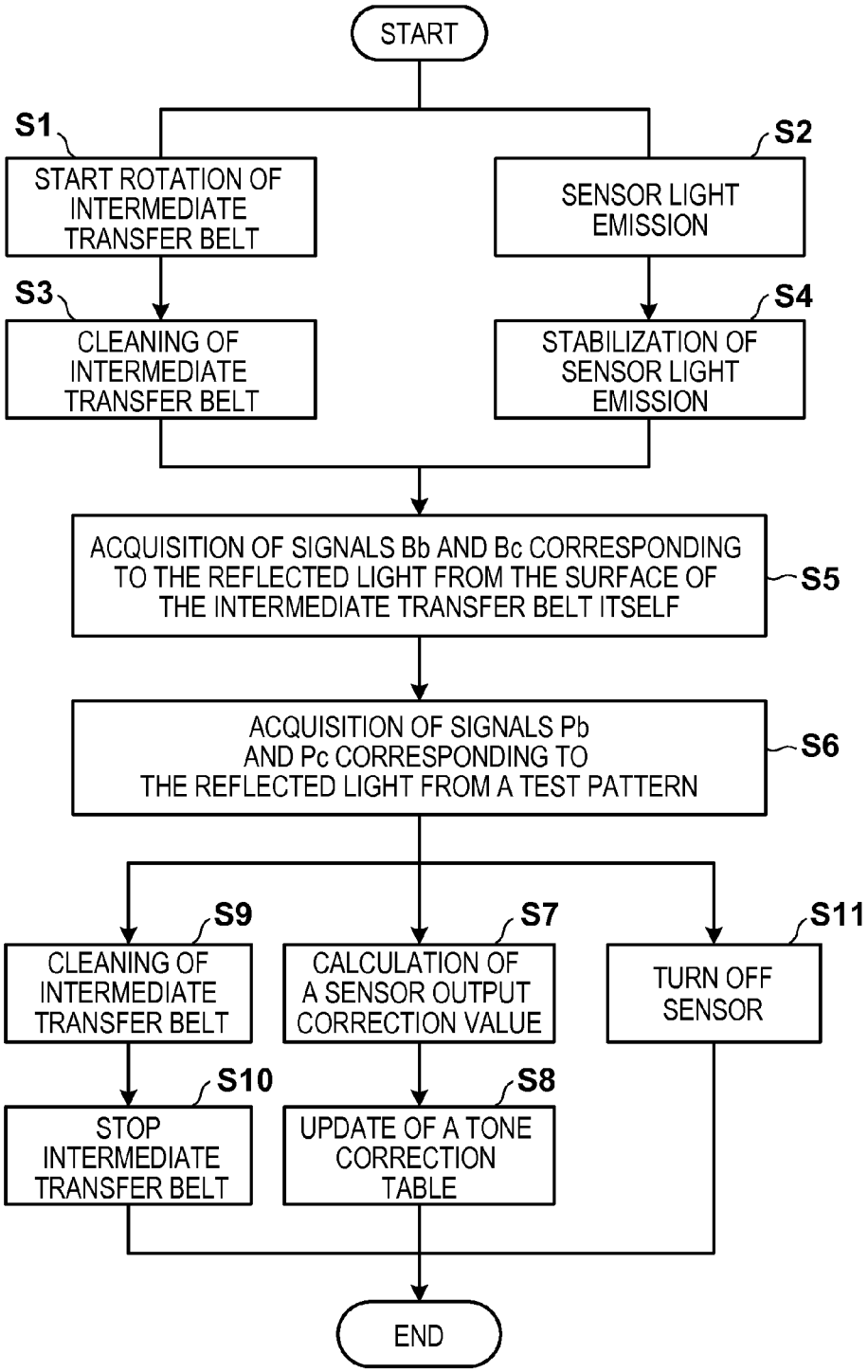
FIG. 4 is a flowchart for density control according to an embodiment.
Figure 5A:
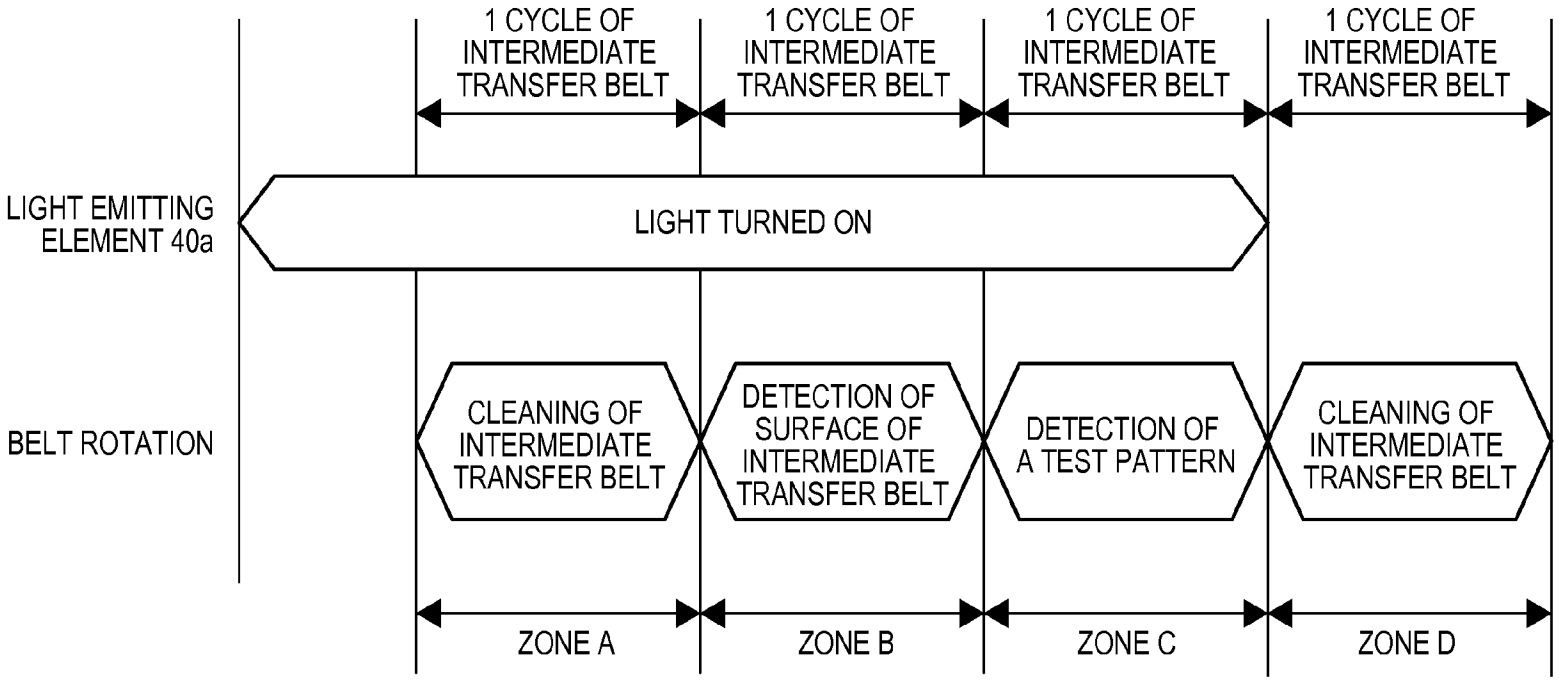
FIGS. 5A and 5B are diagrams illustrating the operation timings of density control according to an embodiment.
Figure 5B:
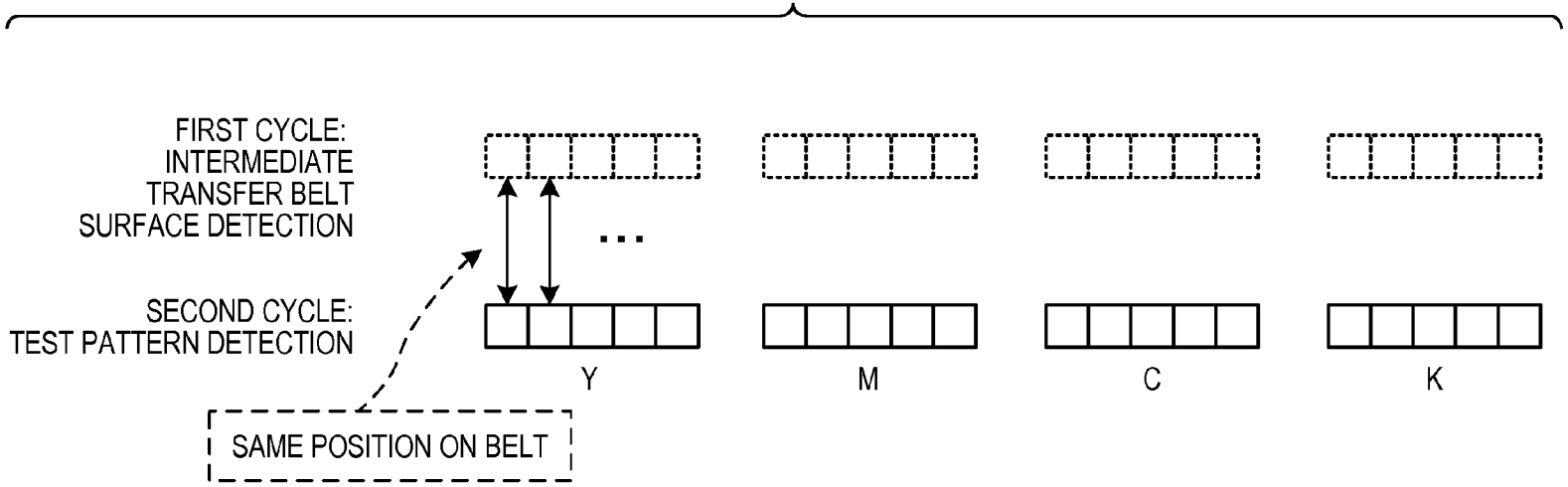

Next, density control according to this embodiment will be explained using FIG. 4, FIGS. 5A and 5B. A CPU 101 rotates an intermediate transfer belt 31 in step S1, at the start of the density control. Further, the CPU 101 causes the light emitting element 40*a* to emit light in step S2 using the light intensity settings for density control stored in the non-volatile memory 109. The CPU 101 causes the intermediate transfer belt 31 to complete one cycle and the cleaning unit 33 to remove the developer adhered to the intermediate transfer belt 31 in step S3. This corresponds to section A of the processing in FIG. 5A. Once the light emission by light emitting element 40*a* stabilizes in step S4, the light receiving elements 40*b* and 40*c* receive reflected light from the surface of the intermediate transfer belt 31 in step S5, and based on this the detection unit 106 obtains signals Bb and Bc output by the light receiving elements 40*b* and 40*c*. This corresponds to section B of the processing in FIG. 5A. Subsequently, once the intermediate transfer belt 31 has completed another cycle, the CPU 101 forms test patterns of yellow (Y), magenta (M), cyan (C), and black (K) on the intermediate transfer belt 31, as shown in FIG. 5B. Light receiving elements 40*b* and 40*c* receive reflected light from a substantially central portion of the test patterns for each color in step S6, and as a result, the detection unit 106 obtains signals Pb and Pc output by the light receiving elements 40*b* and 40*c*. This corresponds to section C of the processing in FIG. 5A. Moreover, as shown in FIG. 5B, the position at which signals Bb, Bd, Pb, and Pc are obtained, or in other words, sampled, is controlled by CPU 101 so as to be in the same position on the intermediate transfer belt 31.

There is some variation in the circumference and rotational cycle of the intermediate transfer belt 31. Therefore, in order to obtain the signal at the same position, it is possible to sample the reflected light from the intermediate transfer belt 31 at fixed intervals, and store all of the sampled values in a RAM 103. Then, it is possible to make a configuration which selects the signals Bb, Bc, Pb, and Pc, corresponding to reflected light from the same portion based on the circumference information (belt revolution time) of intermediate transfer belt 31. Moreover, it is also acceptable for signals Bb and Bc only, or signals Pb and Pc only to be stored in the RAM 103. Furthermore, the circumference information of intermediate transfer belt 31 can be obtained by detecting a circumference detection mark provided on a belt end portion (not shown) using a circumference detection sensor (not shown).

Further, in this embodiment all of the test patterns are accommodated within the circumference of the intermediate transfer belt 31. Once the obtainment of signals Pb and Pc is completed, the light emitting element 40*a* is turned off in step S11. Further, in step S9, cleaning of the intermediate transfer belt 31 is performed in order to remove the test patterns, and after the cleaning is completed, the rotation of the intermediate transfer belt 31 is stopped in step S10. This corresponds to section D of the processing in FIG. 5A. Further, the CPU 101 obtains a sensor output correction value, which is a value that corresponds to the adhered amount of developer, in step S7 based on the results obtained in steps S5 and S6. Various methods can be conceived as a conversion method, for example, the following formula can be used for calculation.

$$\text{Sensor output correction value}=\{Pb-\alpha\times(Pc-Bc)\}/Bb \quad (1)$$

Here, α is a coefficient for calculating the net amount of diffuse reflected light by cancelling the specular reflection spot diameter, the diffuse reflection spot diameter, and the difference in light detection sensitivity therebetween. α is obtained by control using the image forming apparatus and stored in the RAM 103 or non-volatile memory 109. Alternatively, α can be obtained in advance and stored in the ROM 102. For example, if the average value of the specular reflection output and the average value of the diffuse reflection output from the solid image are 0.29V and 2.46V respectively, the ratio of 0.12 thereof can be used as α. Regarding the sensor that detects the specular reflection light amount and the diffuse reflection light amount, usually the diffuse reflection spot diameter is larger than the specular reflection spot diameter in order to secure a light amount sufficient with respect to the specular reflection light amount; therefore, the above matter is generally valid.

Figure 6:
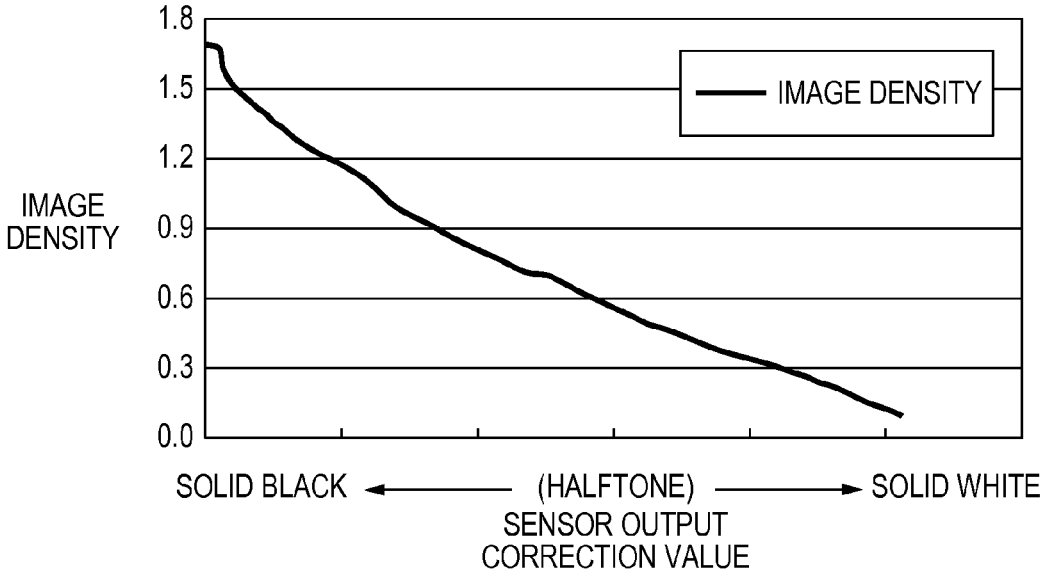
FIG. 6 is a diagram illustrating the relation between sensor output correction values and image density according to an embodiment.

The numerator of equation (1) is the net amount of specular reflection light received by the light receiving element 40*b* when a test pattern is irradiated with light, in other words, it is the value of the amount of light received by the light receiving element 40*b* less the diffuse reflection component. Accordingly, this means that the smaller the sensor output correction value, the greater the adhered amount of developer. The CPU 101 converts the sensor output correction value to the image density when an image is actually printed on a printing medium based on a table corresponding to the graph indicated in FIG. 6, which is stored in the ROM 102 in advance. As indicated in FIG. 6, the sensor output correction value and the image density have a relationship close to linear. Therefore, the fluctuation in sensor output correction value affects the image density fluctuation after density control. The CPU 101 updates a tone correction table in step S8 based on the results of changing the sensor output correction values to image density.

Next, the test pattern and γ correction are explained. In the present embodiment, as a test pattern, a plurality of square halftone images of lengths in the sub-scanning direction (image forming process direction) and in the main-scanning direction (a direction perpendicular to the image forming process direction) of 6 mm and 8 mm respectively can be used. Here, the size of the test pattern in the sub-scanning direction provides a predetermined margin, taking into account the tendency for color misalignment and non-uniformity of the amount of applied developer at the edge of a test pattern, in addition to the irradiation range of the light spot.

Figure 7:
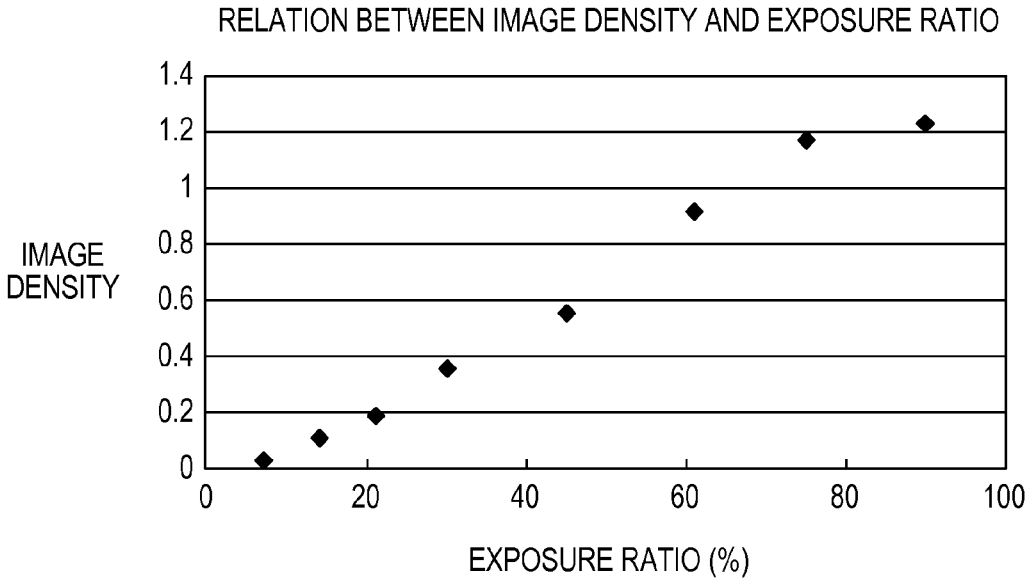
FIG. 7 is a diagram illustrating the relation between exposure ratio and image density according to an embodiment.
Figure 8:
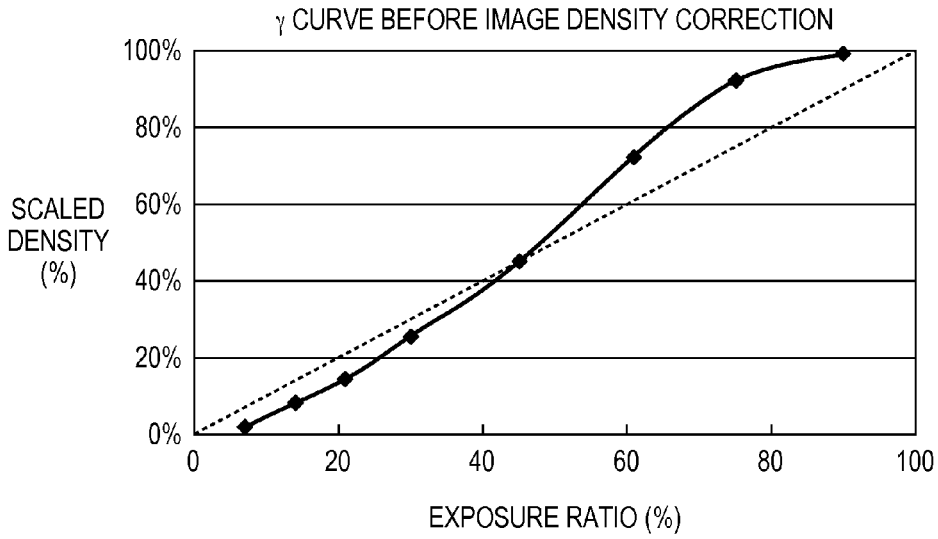
FIG. 8 is a diagram illustrating a $\gamma$ curve before image density correction according to an embodiment.
Figure 9:
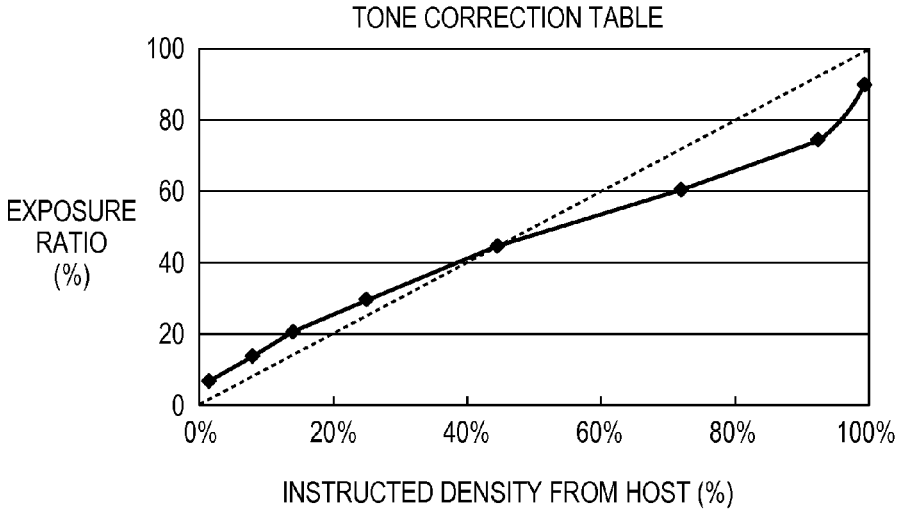
FIG. 9 is a diagram illustrating a tone correction table according to an embodiment.
Figure 10:
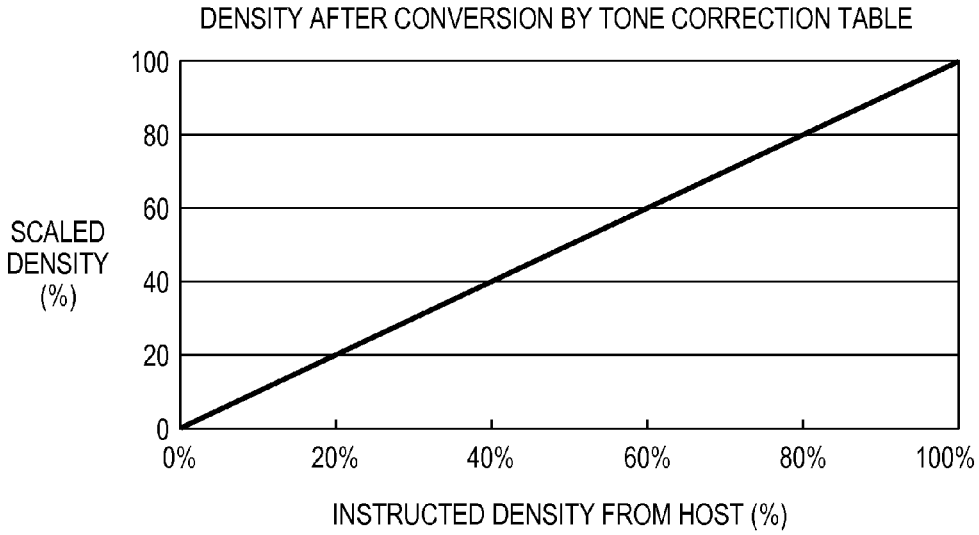
FIG. 10 is a diagram illustrating image density in relation to input image data after execution of density control according to an embodiment.

A multi-valued dither processing used for actual image forming is applied to the test pattern. For example, eight halftone images with exposure ratios of 6%, 13%, 21%, 31%, 43%, 61%, 75%, and 90% according to the exposure unit 4 can be used. A summary of the updating of a tone correction table is as follows. The horizontal axis of FIG. 7 is the exposure ratio, which corresponds to tone. The vertical axis is the image density in the case of printing on printing material. Further, FIG. 8 is scaled using the maximum density (density when the exposure ratio is 100%) of FIG. 7, and a curve approximation has been applied so as to pass through each measurement point. This curve is the γ curve prior to image density correction. Simply put, the vertical and horizontal axes of this γ curve prior to image density correction are switched, producing the table shown in FIG. 9, which gives a tone correction table. By converting the density indicated by input image data from the host using the tone correction table and performing actual image forming, a linear relationship is generated between the image density instructed by the host and the actual density, as shown in FIG. 10, and accurate color reproducibility can be executed.

Figure 13:
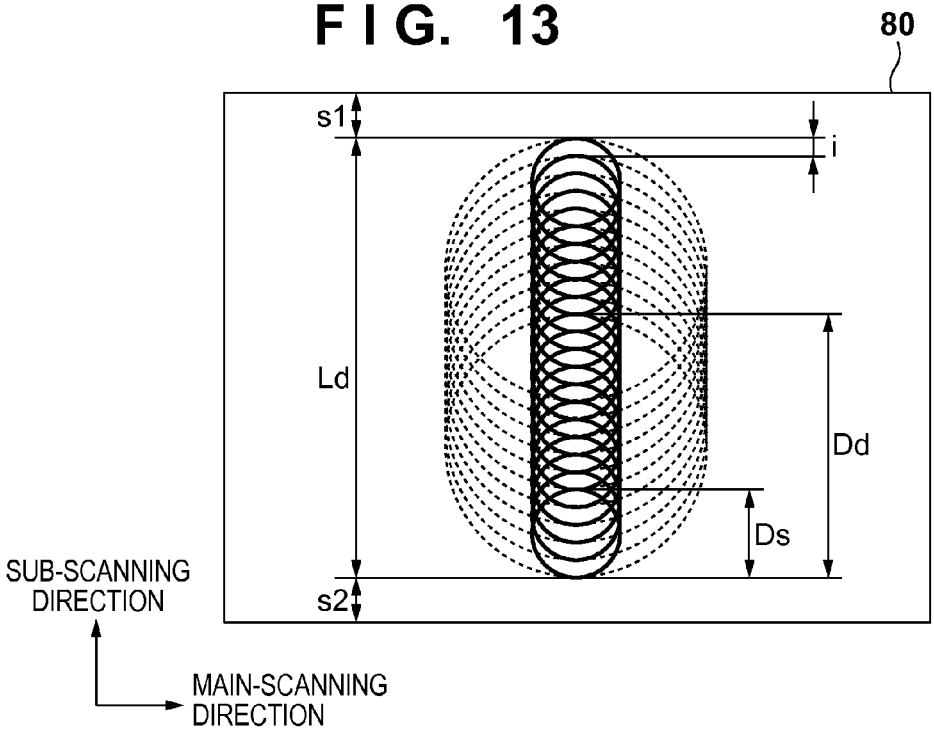
FIG. 13 is a diagram illustrating a sampling position in relation to a test pattern according to an embodiment.

Next, a method of obtaining signals Pb and Pc according to this embodiment will be explained using FIG. 13. In FIG. 13, numeral 80 is a square test pattern, Ds is a specular reflection spot diameter, and Dd is a diffuse reflection spot diameter. FIG. 13 shows from which positions of the test pattern moved by the movement of the intermediate transfer belt 31 the light receiving elements 40*b* and 40*c* receive reflected light. In other words, it indicates the positions at which the light receiving elements 40*b* and 40*c* take a plurality of samples along the movement direction of the test pattern. As described above, the specular reflection spot diameter Ds is smaller than the diffuse reflection spot diameter Dd. Further, the sampling interval of the light receiving elements 40*b* and 40*c* is denoted i, the number of sampling for the specular reflection is denoted m, and the number of sampling for the diffuse reflection is denoted n. Furthermore, in the description below, the sampling interval indicates the movement distance of the intermediate transfer belt 31 between two successive samples. In other words, the sampling interval is not a time interval, but means the distance between the spots of reflected light on the intermediate transfer belt 31 received by the light receiving elements 40*b* and 40*c* in successive samples. At this time, the irradiation length of the specular reflection spot is expressed as i(m−1)+Ds, and the irradiation length of the diffuse reflection spot is expressed as i(n−1)+Dd. Therefore, in a case where m−n=(Dd−Ds)/I is satisfied, the irradiation length of the specular reflection spot and the irradiation length of the diffuse reflection spot in the sub-scanning direction are the same. At this time, the detection precision and the minimization of developer consumption amount is achieved. Further, in FIG. 13, s1 and s2 are margins provided in consideration of the tendency for color misalignment and non-uniformity of the amount of applied developer at the edge of a test pattern.

For example, the specular reflection spot diameter Ds is 1.0 mm, the detection interval i is 0.2 mm, and the number of sampling m for the specular reflection spot is 20 times. In this case, the irradiation length of the specular reflection spot is 0.2×(20−1)+1.0=4.8 mm. Here, the signal Pb is obtained by averaging processing of each sampling value.

Alternatively, for example, if the diffuse reflection spot diameter Dd is 3.0 mm, the sampling interval i is 0.2 mm, and the number of sampling n is 10 times, the irradiation length of the diffuse reflection spot is 0.2×(10−1)+3.0=4.8 mm, which is the same as the irradiation length of the specular reflection spot. Here, signal Pc is obtained by averaging processing of each sampling value. Further, it is possible to change the sampling interval for the specular reflection and diffuse reflection, but the number of interruptions can be reduced by matching the sampling intervals. According to this embodiment, the irradiation lengths of the specular reflection spot and diffuse reflection spot in the sub-scanning direction are equal, and even considering misalignment of the irradiation position, the specular reflection and diffuse reflection can be obtained from the reflected light from the same area.

The fluctuation in detection of the amount of specular reflected light greatly affects the sensor output correction value when the density of the developer image is low. On the other hand, the effect of the fluctuation in amount of diffuse reflected light is greatest when the density of the developer image is high. Therefore, the fluctuation of the amount of specular reflected light from the surface of the intermediate transfer belt 31 itself and of the amount of diffuse reflected light from the test pattern with solid density formed on the intermediate transfer belt 31 was obtained, and moreover, the effects of these fluctuations on the detection precision of the image density was confirmed.

Figure 11:
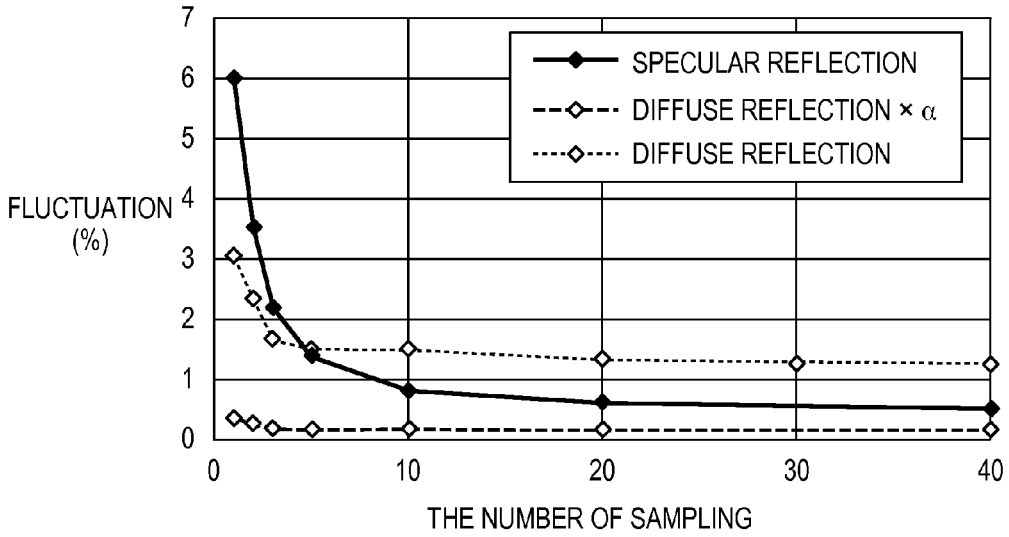
FIG. 11 is a diagram illustrating the relation between a sampling count and detection variation according to an embodiment.

First, regarding specular reflection, light intensity adjustment of the light emitting element 40*a* was performed such that the output of the light receiving element 40*b* at the time of receiving the specular reflection light from the surface of the intermediate transfer belt 31 was 2.5V. In contrast, regarding diffuse reflection, light intensity adjustment of the light emitting element 40*a* was performed such that the output of the light receiving element 40*c* at the time of receiving the diffuse reflection light from the formed test pattern with solid density was 2.5V. The results are shown in FIG. 11. When sampling was performed with a sampling interval i=0.2 mm, in contrast to the fluctuation in amount of specular reflected light of about 6%, the fluctuation in amount of diffuse reflected light was about 3%. From this, it can be understood that the detection of diffuse reflected light is less influenced by the unevenness of the target object than the specular reflected light.

Moreover, it can be understood from FIG. 11 that, regarding specular reflected light, the greater the number of sampling, the smaller the fluctuation. However, as the number of sampling is increased, the consumption amount of developer and the control time increases. For example, in the relation of FIG. 11, by setting the number of sampling at twenty times, where the decrease in fluctuation becomes slow, the fluctuations can be set to about 0.8%. Although the greater the number of sampling, the smaller the fluctuations are for diffuse reflected light, it can be seen that at three times or more, the fluctuations become about 1.5%. Moreover, by calculating the net amount of diffuse reflected light by multiplying the detection results of the amount of diffuse reflected light by a in the calculation of the sensor output correction value, it is possible to suppress the substantial detection fluctuation of the amount of diffuse reflected light to less than 0.2%. For example, the diffuse reflected light sampling count n can be set to 10 times such that the irradiation length of the diffuse reflected spot covers the irradiation length of the specular reflected spot. Accordingly, for example, by using the example numerical values described above, the length irradiated by the specular reflected spot can be suppressed to 4.8 mm while suppressing the light amount detection fluctuation to about 0.8%. Therefore, it is possible to reduce the amount of developer consumed while making the size of the test patterns small and maintaining a high precision density control that suppresses the effects of diffuse reflected light.

Figure 12:
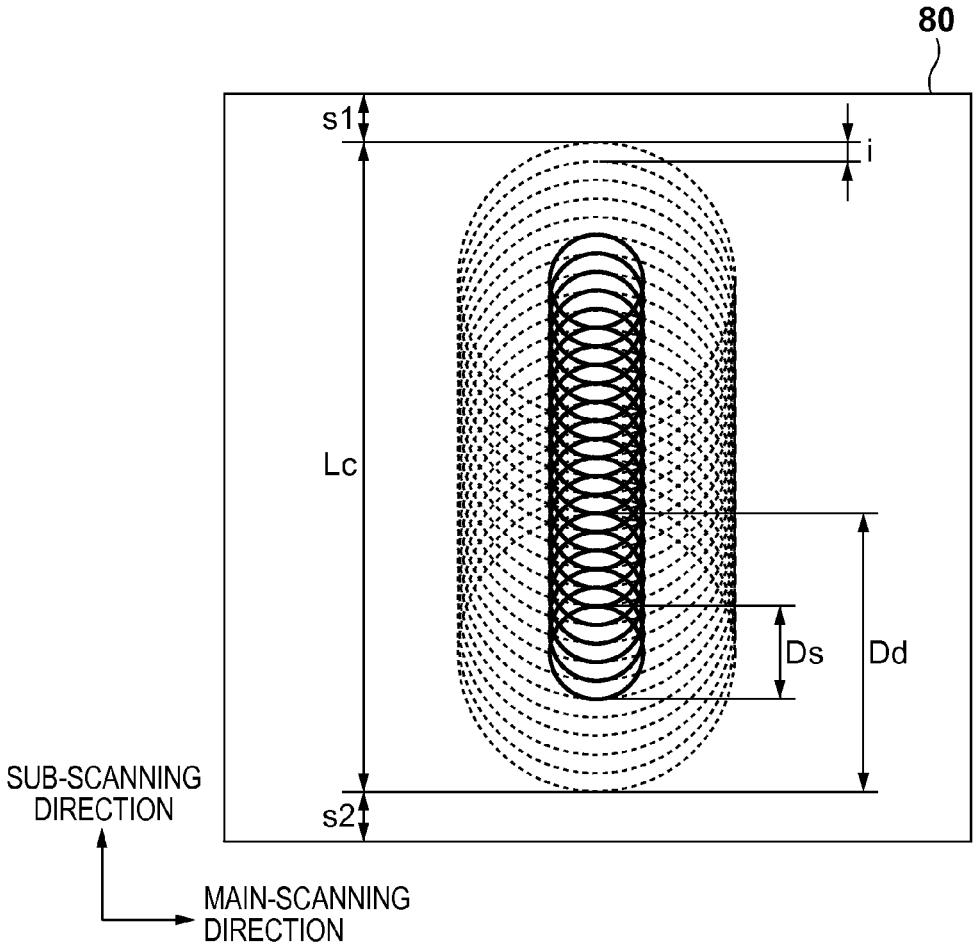
FIG. 12 is a diagram illustrating one example of a conventional sampling position in relation to a test pattern.

Next, a conventional arrangement is shown in FIG. 12, in which the number of sampling of the light receiving elements 40*b* and 40*c* are the same, for comparison. As shown in FIG. 12, in the conventional arrangement, the length of the test pattern in the sub-scanning direction is the total Lc+s1+s2, where Lc is the irradiation length and s1 and s2 are margins. Further, because the number of sampling of the light receiving elements 40*b* and 40*c* are the same, the irradiation length Lc is determined by the diffuse reflected spot diameter Dd and the number of sampling, and the irradiation length of the specular reflected spot is shorter than the irradiation length Lc. In comparison with the conventional arrangement, in this embodiment the number of sampling of the light receiving element 40*c* is made lower than the sampling frequency of the light receiving element 40*b*, and therefore the irradiation length of the diffuse reflected spot Ld in FIG. 13 is shorter than the irradiation length Lc of FIG. 12. Accordingly, it can be understood that the amount of developer consumed in this embodiment, in comparison with the conventional example, is reduced by the amount (Ld+s1+s2)/(Lc+s1+s2). For example, if the diffuse reflected spot diameter Dd is 3.0 mm, the sampling interval i is 0.2 mm, and the number of sampling n is 20 times, the irradiation length Lc becomes 6.8 mm. Further, as described using FIG. 13, if the number of sampling n is set at 10 times, the irradiation length Ld becomes 4.8 mm. Therefore, for example, if s1=s2=0.5 mm, the amount of developer consumed can be reduced by 26%. Further, the smaller the margins s1 and s2, the greater the effect of suppressing consumption of developer.

In this embodiment, the number of sampling described above was used because the target was to have a detection deviation of the image density of less than 1.0%, but the number of sampling may be selected depends on target level. Further, in this embodiment, it is exemplified a case in which the lengths in the sub-scanning direction of the irradiation region of the specular reflected spot and the irradiation region of the diffuse reflected spot are the same, which provide the maximum effect of reducing the amount of developer consumed. However, even in a case in which the lengths of the irradiation regions are approximately equal, the consumption amount of the developer used for density control while maintaining detection precision can be reduced. In other words, it is effective to set the number of sampling for diffuse reflected light lower than that of the specular reflected light. Specifically, the irradiation length of the specular reflected light can be determined, and based on this irradiation length, the number and timing of the sampling of diffuse reflected light can be determined. Conversely, the irradiation length of the diffuse reflected light can be determined, and based on this irradiation length, the number and timing of the sampling of specular reflected light can be determined.

Second Embodiment

Next, a second embodiment will be described. This embodiment is the same as the first embodiment, except for the sampling interval of the amount of reflected light. The size of the test pattern in this embodiment is, for example, the same as the first embodiment: 6 mm×8 mm. However, the detection interval of the specular reflected light amount i is the same as the spot diameter of the specular reflected light, 1.0 mm. Further, as shown in FIG. 14, the number of sampling m of the light receiving element 40*b* is 5 times, and the number of sampling n of the light receiving element 40*c* is three times.

Figure 14:
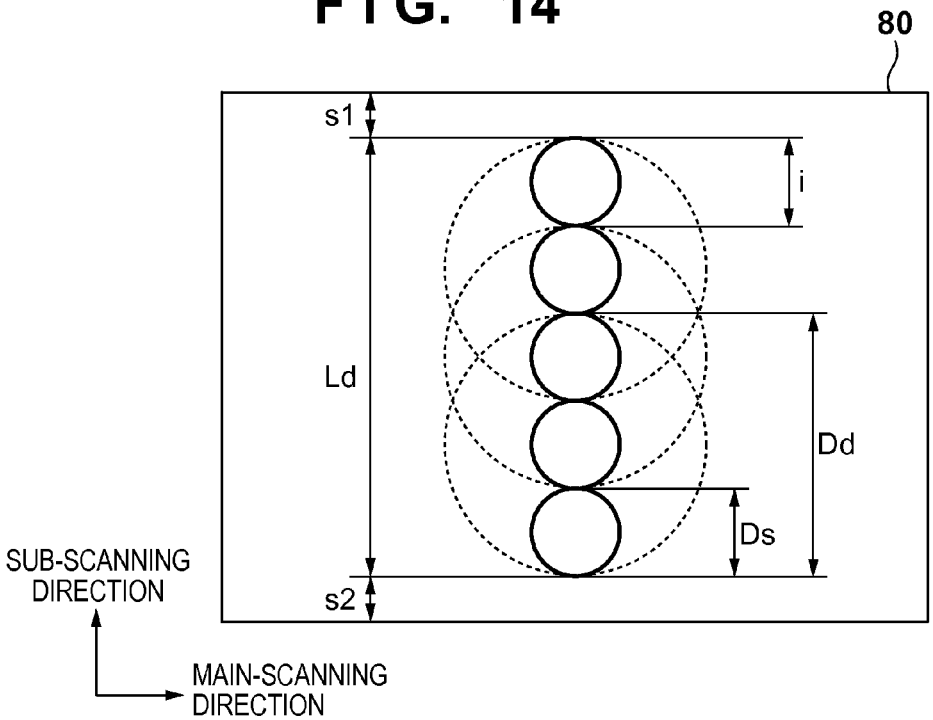
FIG. 14 is a diagram illustrating a sampling position in relation to a test pattern according to an embodiment.

As shown in FIG. 14, the irradiation length of the specular reflected spot is the same as in the first embodiment, but the overlap of the spot is removed. According to this embodiment, the number of detection can largely be reduced, and the memory capacity necessary for storing the sampling values is greatly reduced. Further, the fluctuations in the image forming direction of the intermediate transfer belt 31 is averaged as the surface area, therefore although the detection precision is a little lower in comparison with the arrangement of the first embodiment, this embodiment can be used depends on the target value necessitated by the image forming apparatus.

In other words, it is possible to implement this embodiment in an apparatus arrangement in which the unevenness of the intermediate transfer belt 31 or the developer image is small, and to implement the arrangement of the first embodiment in a case in which the apparatus has a relatively large unevenness and further the demand for detection precision is high.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-237273, filed on Oct. 26, 2012, which is hereby incorporated by reference herein in its entirety.

What is claimed is:

1. An image forming apparatus comprising:

an image carrier;

an image forming unit configured to form a test pattern which is a developer image for density control on the image carrier; and a detection unit including a light emitting element configured to irradiate light directed at the image carrier or the test pattern, and a first light receiving element and a second light receiving element configured to receive reflected light of the light irradiated by the light emitting element;

wherein the image forming apparatus performs control of the image forming conditions for the image forming unit based on a detection result of the test pattern by the detection unit;

a spot diameter of a reflected light received by the first light receiving element is smaller than a spot diameter of a reflected light received by the second light receiving element; and a number of samplings of the test pattern in line with a movement direction of a surface of the image carrier by the first light receiving element is greater than that of the test pattern in line with the moving direction by the second light receiving element.

2. The image forming apparatus of claim 1, wherein intervals in the movement direction of the test pattern sampled by the first light receiving element and the second light receiving element are equal.

3. The image forming apparatus of claim 2, wherein the interval is equal to the spot diameter of reflected light received by the first light receiving element.

4. The image forming apparatus of claim 1, wherein a total length, in the movement direction, of the spot of reflected light received by the first light receiving element throughout a plurality of samplings is equal to a total length, in the movement direction, of the spot of reflected light received by the second light receiving element throughout a plurality of samplings.

5. The image forming apparatus of claim 1, wherein the first light receiving element is provided to receive specular reflected light from the image carrier of the light irradiated by the light emitting element, and the second light receiving element is provided to receive diffuse reflected light from the image carrier of the light irradiated by the light emitting element.

6. An image forming apparatus comprising:

an image carrier;

an image forming unit configured to form a test pattern which is a developer image for density control on the image carrier; and a detection unit including a light emitting element configured to irradiate light directed at the image carrier or the test pattern, and a first light receiving element and a second light receiving element configured to receive reflected light of the light irradiated by the light emitting element;

wherein the image forming apparatus performs control of the image forming conditions for the image forming unit based on a detection result of the test pattern by the detection unit;

a spot diameter of a reflected light received by the first light receiving element is smaller than a spot diameter of a reflected light received by the second light receiving element; and a number of samplings of the test pattern by either one of the first light receiving element or the second light receiving element in line with a movement direction of a surface of the image carrier is obtained based on a number of samplings of the test pattern by the other light receiving element in line with the movement direction.

7. The image forming apparatus of claim 6, wherein intervals in the movement direction of the test pattern sampled by the first light receiving element and the second light receiving element are equal.

8. The image forming apparatus of claim 7, wherein the interval is equal to the spot diameter of reflected light received by the first light receiving element.

9. The image forming apparatus of claim 6, wherein a total length, in the movement direction, of the spot of reflected light received by the first light receiving element throughout a plurality of samplings is equal to a total length, in the movement direction, of the spot of reflected light received by the second light receiving element throughout a plurality of samplings.

10. The image forming apparatus of claim 6, wherein the first light receiving element is provided to receive specular reflected light from the image carrier of the light irradiated by the light emitting element, and the second light receiving element is provided to receive diffuse reflected light from the image carrier of the light irradiated by the light emitting element.

11. The image forming apparatus of claim 6, wherein the number of sampling of the test pattern by either one of the first light receiving element or the second light receiving element is obtained based on a spot length of the other light receiving element obtained by the number of sampling, a sampling interval, and the spot diameter of the other light receiving element.

12. A density detection apparatus comprising:

a light emitting element configured to irradiate light directed at an image carrier or a test pattern which is a developer image for density control formed on the image carrier; and a first light receiving element and a second light receiving element configured to receive reflected light of the light irradiated by the light emitting element;

wherein the density detection apparatus detects a density of the test pattern based on detection results by the first light receiving element and the second light receiving element;

a spot diameter of a reflected light received by the first light receiving element is smaller than a spot diameter of a reflected light received by the second light receiving element; and a number of samplings of the test pattern in line with a movement direction of a surface of the image carrier by the first light receiving element is greater than that of the test pattern in line with the moving direction by the second light receiving element.

13. The density detection apparatus of claim 12, wherein intervals in the movement direction of the test pattern sampled by the first light receiving element and the second light receiving element are equal.

14. The density detection apparatus of claim 13, wherein the interval is equal to the spot diameter of reflected light received by the first light receiving element.

15. The density detection apparatus of claim 12, wherein a total length, in the movement direction, of the spot of reflected light received by the first light receiving element throughout a plurality of samplings is equal to a total length, in the movement direction, of the spot of reflected light received by the second light receiving element throughout a plurality of samplings.

16. The density detection apparatus of claim 12, wherein the first light receiving element is provided to receive specular reflected light from the image carrier of the light irradiated by the light emitting element, and the second light receiving element is provided to receive diffuse reflected light from the image carrier of the light irradiated by the light emitting element.

17. A density detection apparatus comprising:

a light emitting element configured to irradiate light directed at an image carrier or a test pattern which is a developer image for density control formed on the image carrier; and a first light receiving element and a second light receiving element configured to receive reflected light of the light irradiated by the light emitting element;

wherein the density detection apparatus detects a density of the test pattern based on detection results by the first light receiving element and the second light receiving element;

a spot diameter of a reflected light received by the first light receiving element is smaller than a spot diameter of a reflected light received by the second light receiving element; and a number of samplings of the test pattern by either one of the first light receiving element or the second light receiving element in line with a movement direction of a surface of the image carrier is obtained based on a number of samplings of the test pattern by the other light receiving element in line with the movement direction.

18. The density detection apparatus of claim 17, wherein intervals in the movement direction of the test pattern sampled by the first light receiving element and the second light receiving element are equal.

19. The density detection apparatus of claim 18, wherein the interval is equal to the spot diameter of reflected light received by the first light receiving element.

20. The density detection apparatus of claim 17, wherein a total length, in the movement direction, of the spot of reflected light received by the first light receiving element throughout a plurality of samplings is equal to a total length, in the movement direction, of the spot of reflected light received by the second light receiving element throughout a plurality of samplings.

21. The density detection apparatus of claim 17, wherein the first light receiving element is provided to receive specular reflected light from the image carrier of the light irradiated by the light emitting element, and the second light receiving element is provided to receive diffuse reflected light from the image carrier of the light irradiated by the light emitting element.

22. The density detection apparatus of claim 17, wherein the number of sampling of the test pattern by either one of the first light receiving element or the second light receiving element is obtained based on a spot length of the other light receiving element obtained by the number of sampling, a sampling interval, and the spot diameter of the other light receiving element.

* * * * *